US006494530B1

(12) United States Patent
Zheng

(10) Patent No.: US 6,494,530 B1
(45) Date of Patent: Dec. 17, 2002

(54) FOLDABLE CHAIR

(75) Inventor: Edward Zheng, La Verne, CA (US)

(73) Assignee: Tofasco of America, Inc., La Verne, CA (US)

( * ) Notice: Subject to any disclaimer, the term of this patent is extended or adjusted under 35 U.S.C. 154(b) by 0 days.

(21) Appl. No.: 09/663,029

(22) Filed: Sep. 15, 2000

(51) Int. Cl.[7] ..... A47C 4/28
(52) U.S. Cl. ..... 297/16.1; 297/45
(58) Field of Search ..... 297/16.1, 16.2, 297/44, 45, 46, 21, 35, 55, 56, 59; 403/65, 92, 93, 95, 97, 101, 102

(56) References Cited

U.S. PATENT DOCUMENTS 1,381,136 A * 6/1921 Ribeiro ..... 297/45
2,690,792 A * 10/1954 Moss ..... 297/35
5,058,950 A * 10/1991 Mann ..... 297/45
6,082,813 A * 7/2000 Chen ..... 297/16.1 X
6,296,304 B1 * 10/2001 Zheng ..... 297/45
6,322,138 B1 * 11/2001 Tang ..... 297/16.2 X

* cited by examiner

*Primary Examiner*—Peter M. Cuomo
*Assistant Examiner*—Stephen Vu
(74) *Attorney, Agent, or Firm*—Raymond Y. Chan; David & Raymond Patent Group

(57) ABSTRACT

A foldable chair includes a seat frame and a back frame constructed to support a fabric seat thereon. The seat frame includes two pairs of side frame legs, and a pair of front frame legs and a pair of rear frame legs foldably supported between the two pairs of side frame legs. Each frame leg is pivotally connected to the side crossed leg at its end portion in such a manner the foldable chair eliminates four connecting ground pads such that the foldable chair is capable of further extending its shape and size, so as to substantially increase a supporting area of the seat frame.

12 Claims, 10 Drawing Sheets

FOLDABLE CHAIR

BACKGROUND OF THE PRESENT INVENTION

1. Field of Invention

The present invention relates to foldable chair, and more particularly to a foldable chair which eliminates the ground pads thereof in order to further extend the shape of the foldable chair.

2. Description of Related Arts

Referring to FIG. 1, a conventional foldable chair comprises a foldable chair A1 constructed by metal tubes and a seat fabric B1. The foldable chair A1 comprises a plurality of construction tubes A11 to construct a back frame A2 and a seat frame A3 for supporting the fabric seat B1. The seat frame A3 comprises a front pair, a back pair and two side pairs of the construction tubes, wherein each pair of the construction tubes are pivotally connected together where they cross so that the chair frame can be easily unfolded to provide a rigid cross-support for use and be folded up for storage.

The conventional foldable chair further comprises four ground pads for pivotally connecting the lower ends of the front pair, a back pair and two side pairs of the construction tubes respectively in such a manner when the foldable chair is unfolded, the four ground pads are positioned at the four bottom comers of the foldable chair frame A1 respectively. In other words, the ground pads are limited the shape and size of the foldable chair. So, the conventional foldable chair is merely formed a square box shape structure in order to easily and quickly fold into a compact unit. However, the foldable chair cannot be a long chair which substantially increase the supporting area of the fabric seat such that the user is able to sit thereon comfortably.

SUMMARY OF THE PRESENT INVENTION

A main object of the present invention is to provide a foldable chair which eliminates ground pads thereof for further extending a chair frame of the foldable chair.

Another object of the present invention is to provide a foldable chair which can be quickly and easily folded into a compact unit for easily storage and carriage and unfolded for use.

Another object of the present invention is to provide a foldable chair which comprises an inclined back frame structure to enable the user's back to comfortably lie on the foldable chair.

Another object of the present invention is to provide a foldable chair which has a simple construction that every individual is able to fold and unfold the foldable chair in one single motion.

Another object of the present invention is to provide a foldable chair which comprises an arm resting frame structure to enable the user's arms to comfortably support on the arm resting frame of the foldable chair.

Accordingly, in order to accomplish the above objects, the present invention provides a foldable chair, which comprises a seat frame and a back frame constructed to support a fabric seat thereon, wherein the seat frame comprises:

two pairs of side frame legs, wherein each pair of side frame legs comprises a first side crossed leg and a second side crossed leg pivotally connected together where they cross;

a pair of front frame legs pivotally connected together where they cross;

a pair of rear frame legs pivotally connected together where they cross;

a pair of front upper pivot joints for pivotally connecting two upper ends of the two front frame legs with two upper portions of the first side crossed legs respectively;

a pair of front lower pivot joints for pivotally connecting two lower ends of the two front frame legs with two lower portions of the second side crossed legs respectively;

a pair of back upper pivot joints for pivotally connecting two upper ends of the two rear frame legs with two upper ends of the second side crossed legs respectively;

a pair of back lower pivot joints for pivotally connecting two lower ends of the rear frame legs with two lower portions of the first side crossed legs respectively; and whereby, by varying the length of the first and second side crossed legs, the seat frame of the foldable chair is adapted for further extending its shape and size, so as to substantially increase a supporting area of the seat frame.

DETAILED DESCRIPTION OF THE PREFERRED EMBODIMENT

Figure 1:
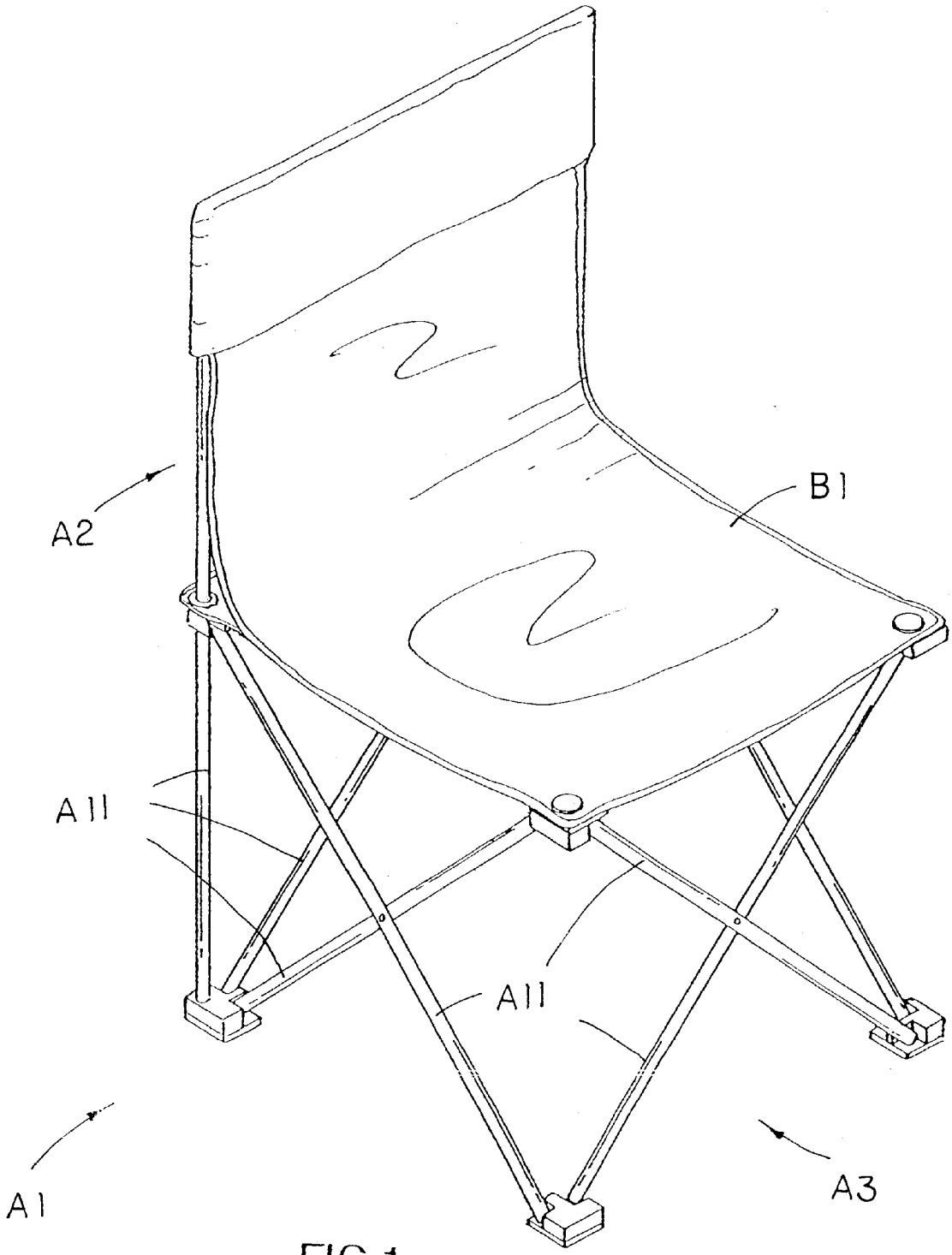
FIG 1 Prior Art
FIG. 1 is a perspective view of a conventional foldable chair.
Figure 2:
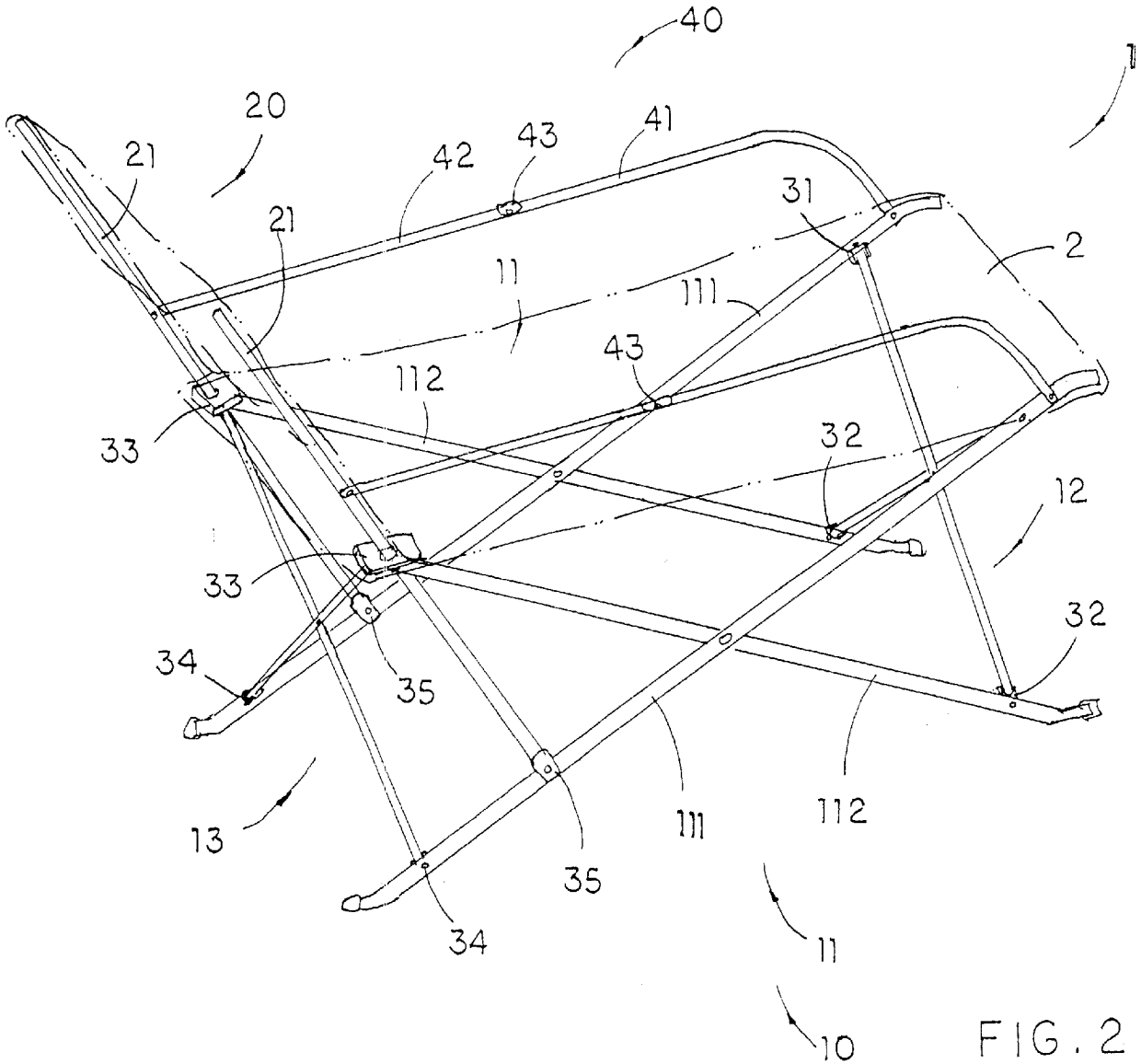
FIG. 2 is a perspective view of a foldable chair according to a first preferred embodiment of the present invention.
Figure 3:
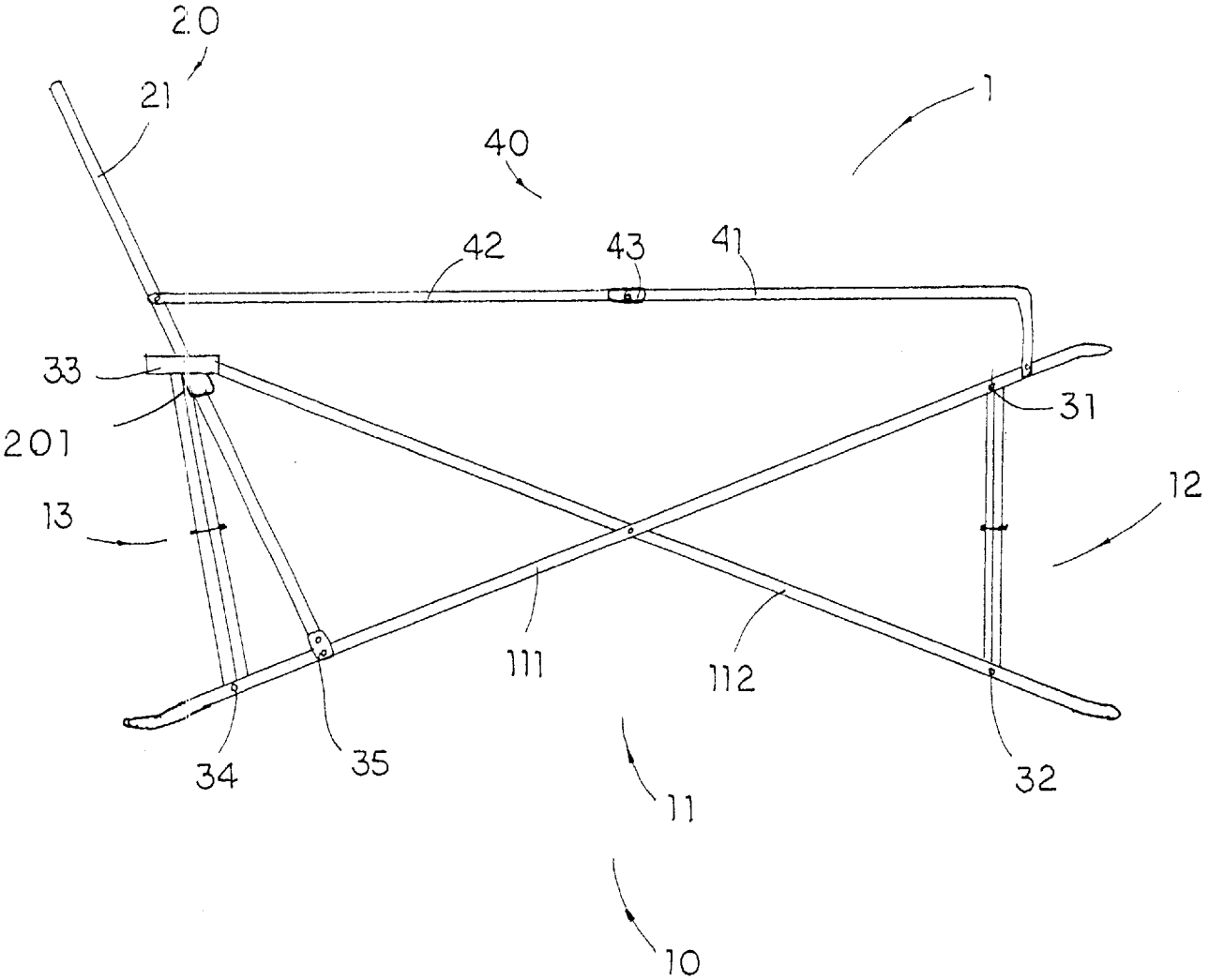
FIG. 3 is a side view of the foldable chair according to the above first preferred embodiment of the present invention.

Referring to FIG. 2 of the drawings, a foldable chair 1 according to a first preferred embodiment of the present invention is illustrated, which comprises a seat frame 10 and a back frame 20 constructed to support a fabric seat 2 thereon.

The seat frame 10 comprises two pairs of side frame legs 11, wherein each pair of side frame legs 11 comprises a first side crossed leg 111 and a second side crossed leg 112 pivotally connected together where they cross, a pair of front frame legs 12 pivotally connected together where they cross, a pair of rear frame legs 13 pivotally connected together where they cross.

The seat frame 10 further comprises a pair of front upper pivot joints 31, a pair of front lower pivot joints 32, a pair of back upper pivot joints 33, and a pair of back lower pivot joints 34.

The pair of front upper pivot joints 31 are adapted for pivotally connecting two upper ends of the two front frame legs 12 with two upper portions of the first side crossed legs 111 respectively, the pair of front lower pivot joints 32 are adapted for pivotally connecting two lower ends of the two front frame legs 12 with two lower portions of the second side crossed legs 112 respectively, the pair of back upper pivot joints 33 are adapted for pivotally connecting two upper ends of the two rear frame legs 13 with two upper ends of the second side crossed legs 112 respectively, and the pair of back lower pivot joints 34 are adapted for pivotally connecting two lower ends of the rear frame legs 13 with two lower portions of the first side crossed legs 111 respectively.

Since the foldable chair 1 eliminates four ground pads thereof which will limit the shape and size of the seat frame 10, such that by varying the length of the first and second side crossed legs, the seat frame 10 of the foldable chair 1 is adapted for further extending its shape and size, so as to substantially increase a supporting area of the seat frame 10. In other words, the seat frame 10 is adapted for forming a rectangular shape such that the user's thigh can be well supported by the extended seat frame. Accordingly, in order to stabilize the foldable chair 1 when the user is supported thereon, the first side crossed legs 111 has a length longer than a length of the second side crossed legs 112 in such a manner when the user lies on the foldable chair 1, the center of mass will not be out of the foldable chair 1, so as to prevent the foldable chair 1 from flip over which will hurt the user.

Figure 5:
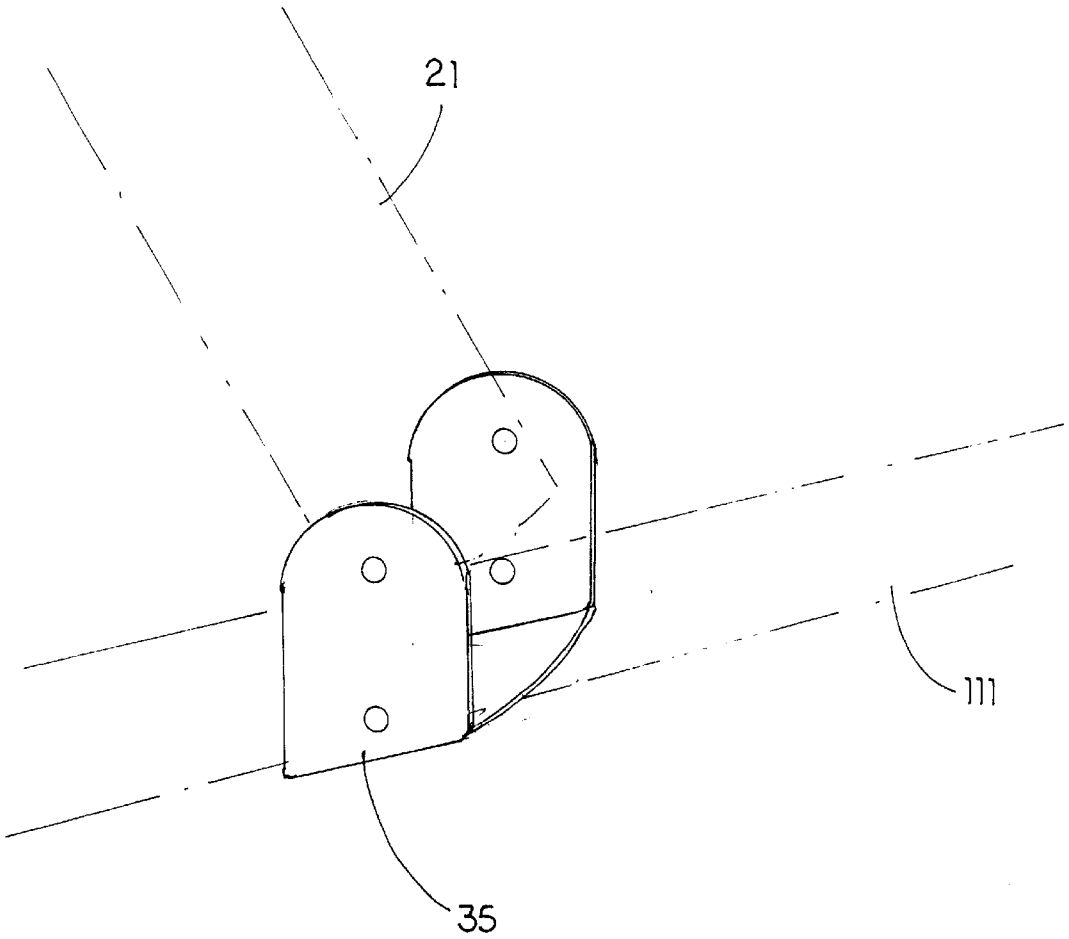
FIG. 5 is a perspective view of a coupling joint of the foldable chair according to the above first preferred embodiment of the present invention.

According to the preferred embodiment, the back frame 20 comprises a pair of inclined back frame legs 21 pass through the two back upper pivot joints 33 respectively, wherein two lower ends of the two back frame legs 21 are respectively extended downwardly to pivotally connected to two U-shaped coupling joints 35 which are affixed to a lower portion of the two first side crossed legs 111 respectively, as shown in FIG. 5. In other words, the two back upper joints 33 are adapted for sliding along the two back frame legs 21 respectively wherein the two lower ends thereof are fixed on the two first side crossed legs 111 respectively, according to the first preferred embodiment of the present invention.

The back frame 20 further comprises a pair of ring shape stoppers 201 respectively affixed at the lower portions of the two back frame legs 21, positioning between the two back upper pivot joints 33 and the two coupling joints 35. The two stoppers 201 are used to block and stop the downward movement of the two back upper pivot joints 33 while unfolding and stretching out the foldable chair 1, so as to lock up the height of the foldable chair and partially support the weight of the user.

Figure 4:
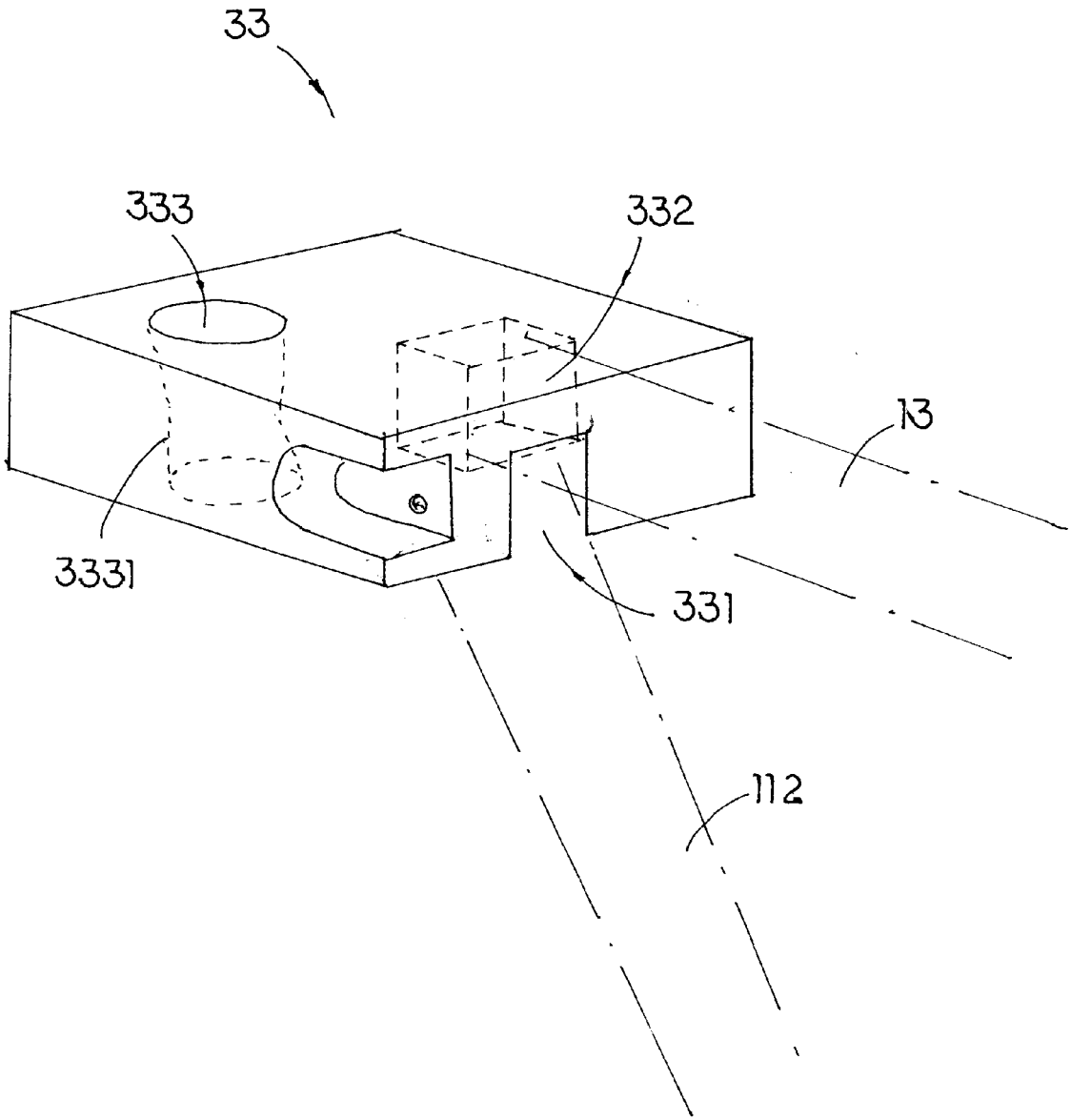
FIG. 4 is a perspective view of a back upper pivot joint of the foldable chair according to the above first preferred embodiment of the present invention.

As shown in FIG. 4, each of the back upper joints 33 has a first pivot slot 331 and a second pivot slot 332 for pivotally connecting with the respective second side crossed leg 112 and the respective rear frame leg 13, and a guiding through hole 333 having an inclined support surface 3331 for supporting the respective inclined back frame leg 21 during the unfolded state, so as to evenly distribute a downward force applied by the user's weight and minimize a stress around the back upper pivot joints 33.

The foldable chair 1 further comprises a pair of arm resting frames 40 foldably supported between the seat frame 10 and the back frame 20. Each arm resting frame 40 comprises a front arm 41 pivotally connected to the front portion of the first side crossed leg 111, a rear arm 42 pivotally connected to an adequate position of the back frame leg 21, and a 180° folding support joint 43 for pivotally connecting between the front and rear arms 41, 42 in such a manner when the foldable chair 1 is unfolded, the front and rear arms 41, 42 are rotatably formed a horizontally supporting area for supporting the user's arms thereon.

Figure 6:
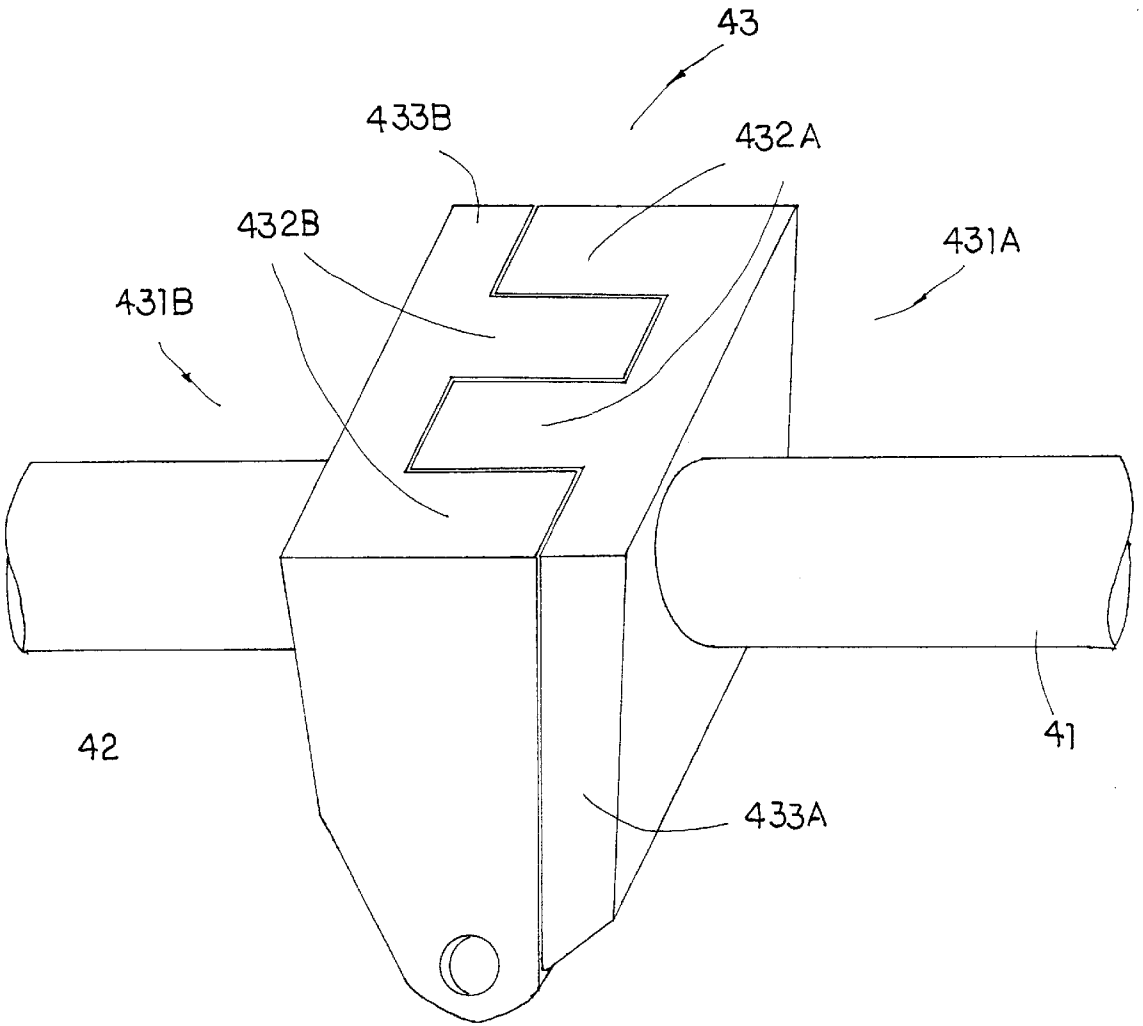
FIG. 6 is a perspective view of a 180° folding support joint of the foldable chair according to the above first preferred embodiment of the present invention.

Accordingly, the 180° folding support joint 43, as shown in FIG. 6, comprises a pair of joint members 431A, 431B each having a U-shaped cross sectional structure comprising a pair of parallel supporting walls 432A (432B) integrally extended therefrom, and a blocking wall 433A (433B) integrally extended from a side of the joint member 431 for limiting the angle of rotation of each joint member 431 such that the joint member 431A is pivotally engaged with another respective joint member 431B by inserting one supporting wall 432A of the joint member 431A between another two supporting walls 432B of the joint member 431B of the same pair of joint members 431. So, each 180° folding support joint 43 is adapted to fold in one direction because the supporting walls 432A of the joint member 431A are biased against the other joint member 432B of the respective pair of joint members 432 while the two joint members 432 are folded together.

Figure 7:
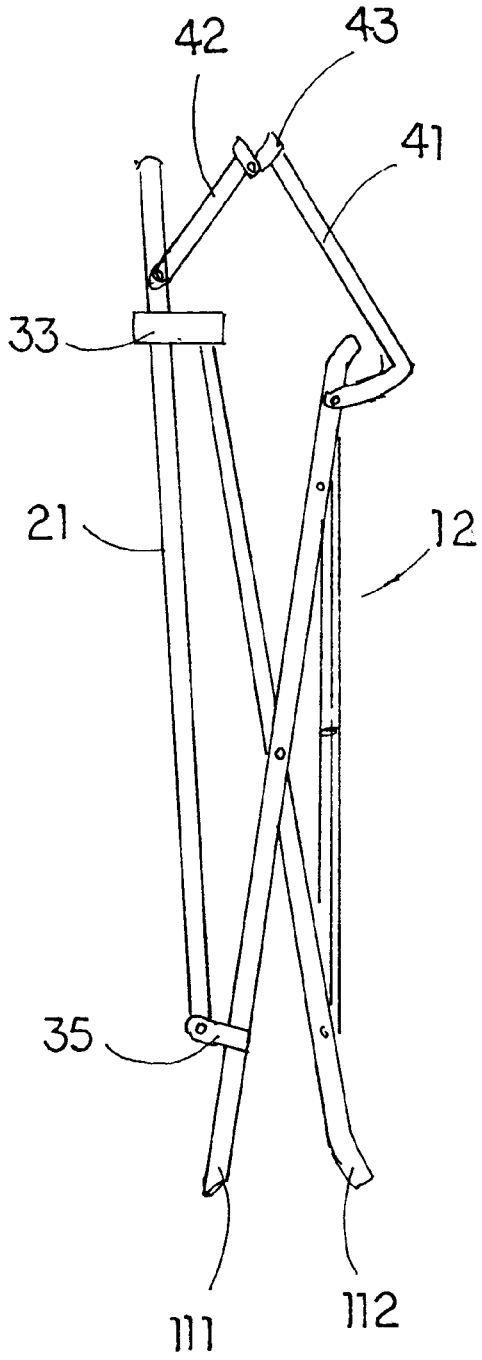
FIG. 7 is a perspective view of the foldable chair in a folded state according to the above first preferred embodiment of the present invention.

So, in the folding process of the foldable chair 1, the circumference of the seat frame 10 is reduced and the height is lengthened in such a manner the two back upper pivot joints 33 are upwardly slid along the two back frame legs 21 respectively, as shown in FIG. 7.

Figure 8:
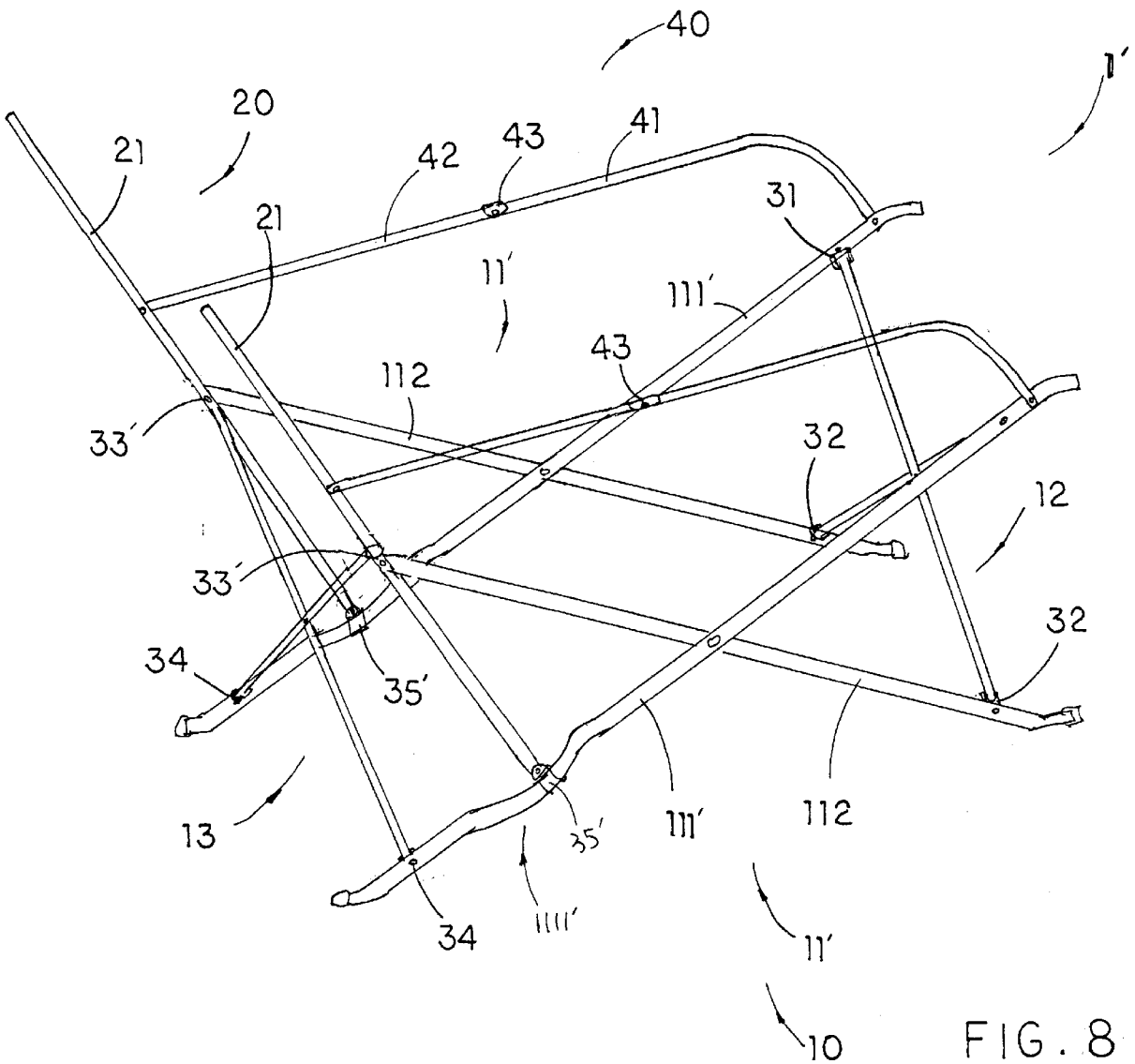
FIG. 8 is a perspective view of the foldable chair according to a second preferred embodiment of the present invention.
Figure 9:
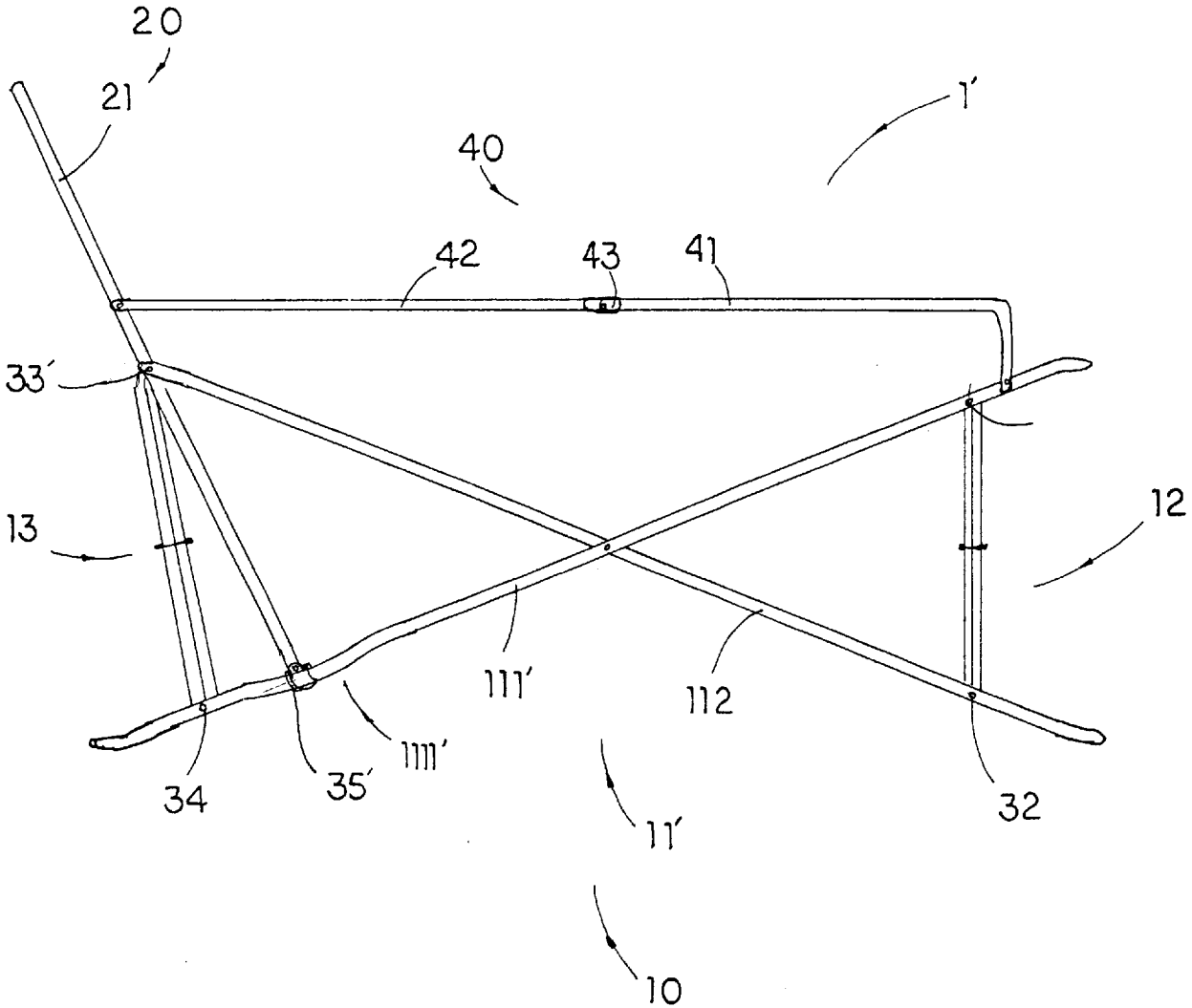
FIG. 9 is a side view of the foldable chair according to the above second preferred embodiment of the present invention.
Figure 10:
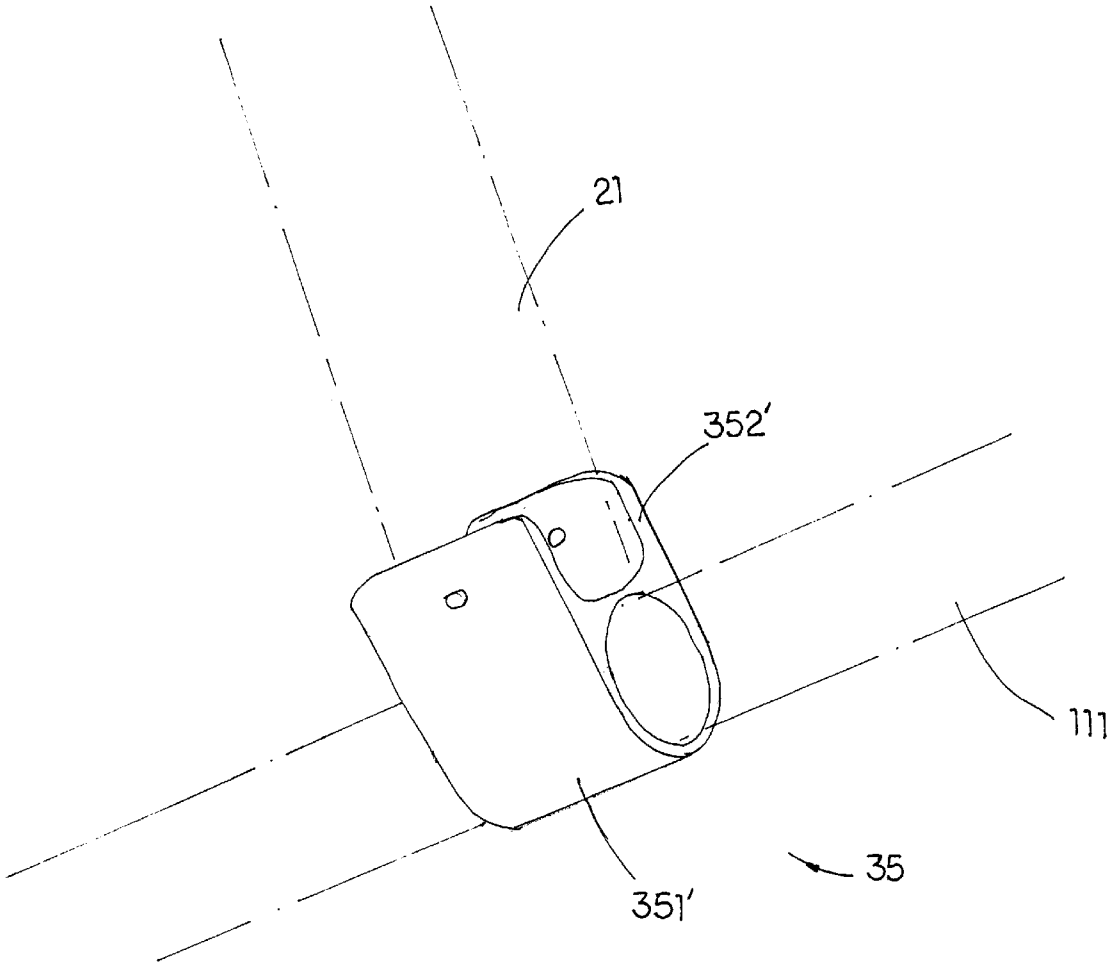
FIG. 10 is a perspective view of a coupling joint of the foldable chair according to the above second preferred embodiment of the present invention.

Referring to FIGS. 8 to 10 of the drawings, a foldable chair 1' according to a second preferred embodiment of the present invention is illustrated, wherein the major difference between the first and second embodiments is the back upper pivot joints 33' are fixed on the two back frame legs 21' and the coupling joints 35' are slidably connected to the two first side crossed legs 111'.

As shown in FIG. 10, each coupling joint 35' comprises a slider body 351' having a slider hole 351A' which has a diameter slightly larger than the respectively first side crossed leg 111' and transversally extended through the slider body 351' for the respective first side crossed leg 111' slidably passing through. Each coupling joints 35' further comprises two parallel arms 352' to pivotally connect the lower end of the respective back frame leg 21' therebetween.

Moreover, each first side crossed leg 111' has a curved section 1111' for the coupling joint 35' sliding along therebetween, as shown in FIG. 9. The curved section 1111' of the first side crossed leg 111' has a curvature equal to a distance between the back upper pivot joint 33' and the curved section 1111' in such a manner the coupling joint 35' is slidably rotated about the back upper pivot joint 33'.

According to the first and second preferred embodiments of the present invention disclosed above, the foldable chair 1 can be formed as a long chair by varying the length of the first and second side crossed legs 111, 112 of the side frame leg 11 because the foldable chair 1 eliminates the use of ground pads that will limit the size and shape of the seat frame 10. So, the foldable chair 1 can substantially increase the supporting area of the seat frame 10 such that the user is able to sit thereon comfortably.

What is claimed is:

1. A foldable chair which comprises a seat frame and a back frame constructed to support a fabric seat thereon and a pair of arm resting frames foldably supported between said seat frame and said back frame;

wherein said seat frame comprises:

two pairs of side frame legs, wherein each said pair of said side frame legs comprises a first side crossed leg and a second side crossed leg pivotally connected together at a crossed point;

a pair of front frame legs pivotally connected together at a crossed point;

a pair of rear frame legs pivotally connected together at a crossed point;

a pair of front upper pivot joints for pivotally connecting two upper ends of said two front frame legs with two upper portions of said first side crossed legs respectively;

a pair of front lower pivot joints for pivotally connecting two lower ends of said two front frame legs with two lower portions of said second side crossed legs respectively;

a pair of back upper pivot joints for pivotally connecting two upper ends of said two rear frame legs with two upper ends of said second side crossed legs respectively; and a pair of back lower pivot joints for pivotally connecting two lower ends of said rear frame legs with two lower portions of said first side crossed legs respectively, whereby by varying a length of said first and second side crossed legs, said seat frame of said foldable chair is adapted for further extending its shape and size, so as to substantially increase a supporting area of said seat frame;

wherein said back frame comprises a pair of inclined back frame legs passing through said two back upper pivot joints respectively, wherein two lower ends of said two back frame legs are respectively extended downwardly to pivotally connected to two coupling joints which are affixed to a lower portion of said two first side crossed legs respectively;

wherein each of said arm resting frames comprises a front arm pivotally connected to said front portion of said first side crossed leg, a rear arm pivotally connected to an adequate position of said back frame leg, and a 180° folding support joint for pivotally connecting between said front and rear arms in such a manner when said foldable chair is unfolded, said front and rear arms are rotatably formed a horizontally supporting area for supporting a user's arms thereon.

2. The foldable chair, as recited in claim 1, wherein said 180° folding support joint comprises a pair of joint members each having a U-shaped cross sectional structure comprising a pair of parallel supporting walls integrally extended therefrom.

3. The foldable chair, as recited in claim 2, wherein said first joint member is pivotally engaged with said second joint member by inserting one supporting wall of said first joint member between another two supporting walls of said second joint member of said same pair of joint members in such a manner that, each said 180° folding support joint is adapted to fold in one direction.

4. The foldable chair, as recited in claim 3, wherein said each of said back upper joints has a first pivot slot and a second pivot slot for pivotally connecting with said respective second side crossed leg and said respective rear frame leg, and a guiding through hole having an inclined support surface for supporting said respective inclined back frame leg during said unfolded state, so as to evenly distribute a downward force applied by a user's weight and minimize stress around said back upper pivot joints.

5. The foldable chair, as recited in claim 1, wherein said each of said back upper joints has a first pivot slot and a second pivot slot for pivotally connecting with said respective second side crossed leg and said respective rear frame leg, and a guiding through hole having an inclined support surface for supporting said respective inclined back frame leg during said unfolded state, so as to evenly distribute a downward force applied by a user's weight and minimize a stress around said back upper pivot joints.

6. A foldable chair which comprises a seat frame and a back frame constructed to support a fabric seat thereon;

wherein said seat frame comprises:

two pairs of side frame legs, wherein each said pair of said side frame legs comprises a first side crossed leg and a second side crossed leg pivotally connected together at a crossed point;

a pair of front frame legs pivotally connected together at a crossed point;

a pair of rear frame legs pivotally connected together at a crossed point;

a pair of front upper pivot joints for pivotally connecting two upper ends of said two front frame legs with two upper portions of said first side crossed legs respectively;

a pair of front lower pivot joints for pivotally connecting two lower ends of said two front frame legs with two lower portions of said second side crossed legs respectively;

a pair of back upper pivot joints for pivotally connecting two upper ends of said two rear frame legs with two upper ends of said second side crossed legs respectively; and a pair of back lower pivot joints for pivotally connecting two lower ends of said rear frame legs with two lower portions of said first side crossed legs respectively, whereby by varying a length of said first and second side crossed legs, said seat frame of said foldable chair is adapted for further extending its shape and size, so as to substantially increase a supporting area of said seat frame;

wherein said back frame comprises a pair of inclined back frame legs passing through said two back upper pivot joints respectively, wherein two lower ends of said two back frame legs are respectively extended downwardly to pivotally connected to two coupling joints which are affixed to a lower portion of said two first side crossed legs respectively, wherein said each of said back upper joints has a first pivot slot and a second pivot slot for pivotally connecting with said respective second side crossed leg and said respective rear frame leg, and a guiding through hole having an inclined support surface for supporting said respective inclined back frame leg during said unfolded state, so as to evenly distribute a downward force applied by a user's weight and minimize a stress around said back upper pivot joints.

7. A foldable chair which comprises a seat frame and a back frame constructed to support a fabric seat thereon and a pair of arm resting frames foldably supported between said seat frame and said back frame;

wherein said seat frame comprises:

two pairs of side frame legs, wherein each said pair of said side frame legs comprises a first side crossed leg and a second side crossed leg pivotally connected together at a crossed point;

a pair of front frame legs pivotally connected together at a crossed point;

a pair of rear frame legs pivotally connected together at a crossed point;

a pair of front upper pivot joints for pivotally connecting two upper ends of said two front frame legs with two upper portions of said first side crossed legs respectively;

a pair of front lower pivot joints for pivotally connecting two lower ends of said two front frame legs with two lower portions of said second side crossed legs respectively;

a pair of back upper pivot joints for pivotally connecting two upper ends of said two rear frame legs with two upper ends of said second side crossed legs respectively; and a pair of back lower pivot joints for pivotally connecting two lower ends of said rear frame legs with two lower portions of said first side crossed legs respectively, whereby by varying a length of said first and second side crossed legs, said seat frame of said foldable chair is adapted for further extending its shape and size, so as to substantially increase a supporting area of said seat frame;

wherein said back frame comprises a pair of inclined back frame legs pivotally connected to said two back upper pivot joints respectively, wherein two lower ends of said two back frame legs are respectively extended downwardly to pivotally connect to two coupling joints which are slidably connected to a lower portion of said two first side crossed legs respectively;

wherein each of said arm resting frames comprises a front arm pivotally connected to said front portion of said first side crossed leg, a rear arm pivotally connected to an adequate position of said back frame leg, and a 180° folding support joint for pivotally connecting between said front and rear arms in such a manner, that when said foldable chair is unfolded, said front and rear arms are rotatably formed a horizontally supporting area for supporting a user's arms thereon.

8. The foldable chair, as recited in claim 7, wherein said 180° folding support joint comprises a pair of joint members each having a U-shaped cross sectional structure comprising a pair of parallel supporting walls integrally extended therefrom.

9. The foldable chair, as recited in claim 8, wherein said first joint member is pivotally engaged with said second joint member by inserting one supporting wall of said first joint member between another two supporting walls of said second joint member of said same pair of joint members in such a manner, that each said 180° folding support joint is adapted to fold in one direction.

10. The foldable chair, as recited in claim 9, wherein each said coupling joint comprises a slider body having a slider hole which has a diameter slightly larger than said respectively first side crossed leg and transversally extended through said slider body for said respective first side crossed leg slidably passing through, and two parallel arms to pivotally connect said lower end of said respective back frame leg therebetween.

11. The foldable chair, as recited in claim 7, wherein each said coupling joint comprises a slider body having a slider hole which has a diameter slightly larger than said respectively first side crossed leg and transversally extended through said slider body for siad respective first side crossed leg slidably passing through, and two parallel arms to pivotally connect said lower end of said respective back frame leg therebetween.

12. A foldable chair which comprises a seat frame and a back frame constructed to support a fabric seat thereon;

wherein said seat frame comprises:

two pairs of side frame legs, wherein each said pair of said side frame legs comprises a first side crossed leg and a second side crossed leg pivotally connected together at a crossed point;

a pair of front frame legs pivotally connected together at a crossed point;

a pair of rear frame legs pivotally connected together at a crossed point;

a pair of front upper pivot joints for pivotally connecting two upper ends of said two front frame legs with two upper portions of said first side crossed legs respectively;

a pair of front lower pivot joints for pivotally connecting two lower ends of said two front frame legs with two lower portions of said second side crossed legs respectively;

a pair of back upper pivot joints for pivotally connecting two upper ends of said two rear frame legs with two upper ends of said second side crossed legs respectively; and a pair of back lower pivot joints for pivotally connecting two lower ends of said rear frame legs with two lower portions of said first side crossed legs respectively, whereby by varying a length of said first and second side crossed legs, said seat frame of said foldable chair is adapted for further extending its shape and size, so as to substantially increase a supporting area of said seat frame;

wherein said back frame comprises a pair of inclined back frame legs pivotally connected to said two back upper pivot joints respectively, wherein two lower ends of said two back frame legs are respectively extended downwardly to pivotally connect to two coupling joints which are slidably connected to a lower portion of said two first side crossed legs respectively, wherein each said coupling joint comprises a slider body having a slider hole which has a diameter slightly larger than said respectively first side crossed leg and transversally extended through said slider body for said respective first side crossed leg slidably passing through, and two parallel arms to pivotally connect said lower end of said respective back frame leg therebetween.

* * * * *